US009434889B2

(12) United States Patent
Subramaniyam

(10) Patent No.: US 9,434,889 B2
(45) Date of Patent: Sep. 6, 2016

(54) ADDITIVE AND METHOD FOR REMOVAL OF CALCIUM FROM CRUDE OILS CONTAINING CALCIUM NAPHTHENATE

(75) Inventor: Mahesh Subramaniyam, Mumbai (IN)

(73) Assignee: Dorf Ketal Chemicals (India) Private Limited, Mumbai (IN)

( * ) Notice: Subject to any disclaimer, the term of this patent is extended or adjusted under 35 U.S.C. 154(b) by 367 days.

(21) Appl. No.: 13/885,216

(22) PCT Filed: Nov. 14, 2011

(86) PCT No.: PCT/IN2011/000786

§ 371 (c)(1),
(2), (4) Date: May 14, 2013

(87) PCT Pub. No.: WO2012/066566

PCT Pub. Date: May 24, 2012

(65) Prior Publication Data

US 2013/0233770 A1 Sep. 12, 2013

(30) Foreign Application Priority Data

Nov. 15, 2010 (IN) ..... 3111/MUM/2010

(51) Int. Cl.

| | |
|---|---|
| ***C10G 29/22*** | (2006.01) |
| ***C10G 17/02*** | (2006.01) |
| ***C10G 19/00*** | (2006.01) |
| ***C10G 31/08*** | (2006.01) |

(52) U.S. Cl.

CPC ..... *C10G 29/22* (2013.01); *C10G 17/02* (2013.01); *C10G 19/00* (2013.01); *C10G 31/08* (2013.01); *C10G 2300/202* (2013.01); *C10G 2300/80* (2013.01)

(58) Field of Classification Search

CPC ..... C10G 33/00; C10G 33/04; C10G 29/22; C10G 19/00; C10G 31/08; C10G 17/02; C10G 2300/80; C10G 2300/202

See application file for complete search history.

(56) References Cited

U.S. PATENT DOCUMENTS

| | | | | |
|---|---|---|---|---|
| 4,476,930 | A | 10/1984 | Watanabe | |
| 5,284,635 | A | 2/1994 | Frederic | |
| 6,068,056 | A | 5/2000 | Frenier et al. | |
| 2009/0283449 | A1 * | 11/2009 | Subramaniyam | 208/252 |

FOREIGN PATENT DOCUMENTS

| | | | |
|---|---|---|---|
| WO | 2009113095 | A2 | 9/2009 |
| WO | 2010128523 | A2 | 11/2010 |
| WO | 2012066566 | A1 | 5/2012 |

OTHER PUBLICATIONS

DOBA15B Assay, ExxonMobil, http://www.exxonmobil.com/crudeoil/download/DOBA15B.pdf (downloaded Jun. 18, 2015).*

Foreign communication from the priority application—International Search Report and Written Opinion, PCT/IN2011/000786 dated Apr. 24, 2012, 9 pages.

Foreign communication from the priority application—Second Written Opinion, PCT/IN2011/000786 dated Oct. 17, 2012, 6 pages.

Foreign communication from the priority application—International Preliminary Report on Patentability, PCT/IN2011/000786 dated Jan. 23, 2013, 6 pages.

* cited by examiner

*Primary Examiner* — Renee E Robinson
*Assistant Examiner* — Derek Mueller
(74) *Attorney, Agent, or Firm* — Conley Rose, P.C.; Rodney B. Carroll

(57) ABSTRACT

There is provided an additive and method for removal of calcium from crude oil or its blends containing calcium naphthenate at low pH as well as at high pH. Particularly, there is also provided an additive and method for removal of calcium from crude oil or its blends containing calcium naphthenate under basic or alkaline conditions and at low pH as well as at high pH varying from about 5 to 11.

8 Claims, No Drawings

ADDITIVE AND METHOD FOR REMOVAL OF CALCIUM FROM CRUDE OILS CONTAINING CALCIUM NAPHTHENATE

CROSS-REFERENCE TO RELATED APPLICATIONS

This application is a filing under 35 U.S.C. 371 of International Application No. PCT/IN2011/000786 filed Nov. 14, 2011, entitled "Additive and Method for Removal of Calcium from Crude Oils Containing Calcium Naphthenate," which claims priority to Indian Patent Application No. 3111/MUM/2010 filed Nov. 15, 2010, which applications are incorporated by reference herein in their entirety.

FIELD OF THE INVENTION

The present invention relates to an additive and method for removal of calcium from crude oils containing calcium naphthenate, wherein the additive is effective to remove the calcium not only at low pH but also at high pH of the wash water for the desalter used in the crude oil processing system.

In particular, the present invention relates to an additive and method for removal of calcium from crude oils containing calcium naphthenate, wherein the additive is effective to remove the calcium under basic or alkaline conditions and having a pH varying from about 5 to 11, preferably from about 6 to 11, more preferably from about 7 to 11, even more preferably from about 9 to 11 of the wash water for the desalter used in the crude oil processing system.

BACKGROUND OF THE INVENTION

The DOBA is a high acid crude oil originating from the Chad region of West Africa. The DOBA is known to contain calcium naphthenate and the amount of calcium naphthenate varies over a range from about 150 to about 700 ppm. In a typically supplied DOBA crude oil, the amount of calcium naphthenate may vary from about 250-about 300 ppm.

The DOBA is a heavy high acid crude oil with Total Acid Number [TAN] ranging upwards of 4.0 mg KOH/gm of sample and the API gravity is about 19. The sulfur content in DOBA is very low to nil.

The DOBA is typically a crude oil with a lot of residue in it and for proper blending, typically internationally, refiners blend it with very light crude oil or condensates to increase the API of the resulted blend to more than 30. Such blending with light crude oil or condensates helps to create sufficient light ends to help achieve product yields for the crude distillation unit. The most of light crude oil or condensates thus selected generally have very little to nil sulfur contents, which means the overall sulfur content still remains very low. Further, the $H_2S$ being oil soluble is not present in relatively higher quantities in these types of blends.

The inventor of present invention has observed that if solution of calcium naphthenate in an organic solvent, for example toluene having concentration of Ca of about 2247 ppm is treated with equal weight of water by heating to about 130 degree C., that is, being equal to a crude oil having very little to nil sulfur contents or say in absence of sulfur compound in a Parr autoclave under autogenous pressure, and separated into organic and aqueous layers in a separating funnel, no black layer is formed at the interface in presence of water or say in presence of very little to nil sulfur contents, being less than 0.2%. When organic layer, as separated, was dried by evaporating toluene, its acid value was found to be very low—about 48.36 (mg KOH per gm). The low Acid Value indicates that calcium naphthenate does not hydrolyze appreciably merely in presence of water or say in presence of very little to nil sulfur contents, being less than 0.2%.

The inventor of present invention has observed that when DOBA or its blend containing calcium naphthenate with no sulfur or sulfur contents being very little [less than 0.2%] is treated with additives as known in the art, for example with glycolic acid it does not hamper removal of metals including calcium from such DOBA crude oil or its blend.

However, the inventor has experimentally found that even with very little to nil sulfur contents, the efficiency of glycolic acid to remove calcium from crude oils containing calcium naphthenate is very low, which surprisingly reduces further if the pH of the crude oil increases to about 6 or to about 11 due to presence of ammonium hydroxide or ammonia or other nitrogen compounds in wash water for desalter.

The inventor of present invention has also observed that when DOBA or its blend containing calcium naphthenate with no sulfur or sulfur contents being very little [less than 0.2%] is treated with additives as known in the art, for example with malic acid, it does not hamper removal of metals including calcium from such DOBA crude oil or its blend.

However, the inventor has experimentally also found that even with very little to nil sulfur contents, the efficiency of malic acid to remove calcium from crude oils containing calcium naphthenate is very low, which surprisingly reduces further if the pH of the crude oil increases to about 6 or to about 9 or to about 11 due to presence of ammonium hydroxide or ammonia or other nitrogen compounds in wash water for desalter.

Inventor's above findings confirm that prior art additives—glycolic acid and malic acid are effective to remove calcium from DOBA crude oil, but with very low efficiency, and this efficiency, surprisingly, reduces further if pH of the crude oil or wash water increase to about 6 or to about 9 or to about 11.

The inventor has also found that efficiency of prior art additives—maleic anhydride, citric acid, D-gluconic acid to remove calcium from DOBA crude oil is very low particularly when pH of the crude oil or wash water increase to about 6 or preferably to about 9 or to about 11.

Accordingly, the industry processing DOBA or its blends containing calcium naphthenate even with very little to nil sulfur contents faces serious problems in removing calcium from such oil or its blends at pH varying from about 6 to about 11 of the wash water for desalter.

Problem to be Solved by the Invention

Therefore, the problem to be solved by present invention is to provide an additive and method for removal of calcium from crude oils or its blends containing calcium naphthenate, which should be effective to remove the calcium from crude oil or its blends not only at low pH but also at high pH, particularly under basic or alkaline conditions of the wash water for the desalter used in the crude oil processing system.

With above aim, the inventor has tried to solve the above described industrial problem with known additives—glycolic acid (the mono basic hydroxyl acid) and malic acid (the dibasic hydroxyl acid), and maleic anhydride, D-gluconic acid, and found that when solution of calcium naphthenate in toluene was treated with equal weight of water containing the additive—glycolic acid or malic acid or maleic anhydride, or D-gluconic acid, the efficiency of these acids to remove calcium from the crude oils containing calcium naphthenate is very low, which surprisingly reduces further if the pH of the crude oil (of the wash water for desalter) increases to about 6 or to about 9 or to about 11.

It is understood from the foregoing description that the prior art additives, which may be effective to remove calcium from DOBA crude oil, but with very low efficiency, and this efficiency to remove calcium reduces further if pH of the crude oil or wash water increases to about 6 or to about 9 or to about 11.

Need of the Invention

The mechanism of reduced efficiency of glycolic acid, malic acid, maleic anhydride, and D-gluconic acid to remove calcium from crude oil containing calcium naphthenate, particularly of further reduced efficiency of glycolic acid, malic acid, maleic anhydride, and D-gluconic acid to remove calcium from crude oil containing calcium naphthenate under basic or alkaline conditions of wash water for desalter and at pH varying from about 5 to about 11, preferably from about 6 to 11, more preferably from about 7 to 11, even more preferably from about 9 to 11 could not be visualized at present. However, the problem to remove calcium from crude oil or its blends containing calcium naphthenate under basic or alkaline conditions of the wash water of desalter still remains unresolved.

Therefore, there is a need to have an additive and method for removal of calcium from crude oils or its blends containing calcium naphthenate which is effective in removing the calcium under basic or alkaline conditions of wash water for desalter and at a pH varying from about 5 to about 11, preferably from about 6 to 11, more preferably from about 7 to 11, even more preferably from about 9 to 11 of the wash water for the desalter used in the crude oil processing system.

Objects and Advantages of the Invention

Accordingly, the main object of the present invention is to provide an additive and method of its use which is effective for removal of calcium from crude oils or its blends containing calcium naphthenate not only at low pH but also at high pH of the wash water for the desalter used in the crude oil processing system.

In particular, the main object of the present invention is to provide an additive and method of its use which is effective for removal of calcium from crude oils or its blends containing calcium naphthenate under basic or alkaline conditions of wash water for desalter and at a pH varying from about 5 to about 11.

In another particular embodiment, the object of the present invention is to provide an additive and method of its use which is effective for removal of calcium from crude oils or its blends containing calcium naphthenate under basic or alkaline conditions of wash water for desalter, which may be due to presence of a compound selected from the group comprising ammonium hydroxide, ammonia, nitrogen compounds, basic compounds and alkaline compounds and at a pH varying from about 5 to about 11, preferably from about 6 to 11, more preferably from about 7 to 11, even more preferably from about 9 to 11.

Other objects and advantages of the present invention will become more apparent when the following description is read in conjunction with following examples and accompanying figures, which are not intended to limit the scope of present invention.

DESCRIPTION AND PREFERRED EMBODIMENTS OF THE INVENTION

With aim to solve above-described industrial problem of the prior art, the inventor of present invention has found that when glyoxylic acid is employed as an additive in processing of crude oils or its blends containing calcium naphthenate in presence of water, it not only removes the calcium from the crude oil or its blends at low pH, but, surprisingly and effectively, it also removes calcium from the crude oil or its blends at high pH of about 6 to about 11, particularly of pH of about 7 to about 11, more particularly of pH of about 9 to about 11 of the wash water for the desalter used in the crude oil processing system, and that's too without causing any problem.

Accordingly, the present invention relates to an additive for removing calcium from crude oil or its blends containing calcium naphthenate at low pH as well as at high pH, wherein the additive is glyoxylic acid.

In another embodiment, the present invention relates to a method for removing calcium from crude oil or its blends containing calcium naphthenate at low pH as well as at high pH, wherein the additive added to crude oil or its blend or the wash water for the desalter is glyoxylic acid.

In yet another embodiment, the present invention relates to use of glyoxylic acid for removal of calcium from crude oil or its blends containing calcium naphthenate at low pH as well as at high pH.

In accordance with one of the embodiments of the present invention, the glyoxylic acid may be added to or mixed with crude oil or its blend or the wash water for the desalter.

It may be noted that the inventor has particularly found that even with very little to nil sulfur contents, the efficiency of additives known in the prior art to remove calcium from crude oils containing calcium naphthenate is very low, which surprisingly reduces further if the pH of the crude oil increases up to about 7 or up to about 9 or up to about 11 due to basic or alkaline conditions, which may be due to the presence of a compound selected from the group comprising ammonium hydroxide, ammonia, nitrogen compounds, basic compounds and alkaline compounds in wash water for desalter.

With aim to solve above industrial problem of the prior art, the inventor of present invention has found that when glyoxylic acid is employed as an additive in processing of crude oils or its blends containing calcium naphthenate in presence of water and under basic or alkaline conditions, which may be due to the presence of a compound selected from the group comprising ammonium hydroxide, ammonia, nitrogen compounds, basic compounds and alkaline compounds in wash water for desalter, it, surprisingly and unexpectedly, removes the calcium from the crude oil or its blends even if the pH of the crude oil processing mixture has increased up to about 7 or up to about 9 or up to about 11 under basic or alkaline conditions, which may be due to the presence of ammonium hydroxide, ammonia, nitrogen compounds, basic compounds and alkaline compounds in wash water for desalter, and that's too without causing any problem.

Accordingly, in preferred embodiment, the present invention relates to an additive for removing calcium from crude oil or its blends containing calcium naphthenate under basic or alkaline conditions and having a pH varying from about 5 to 11, wherein the additive is glyoxylic acid.

In accordance with one of the preferred embodiments of the present invention, the basic or alkaline conditions of crude processing system (crude oil or its blends or wash water) are due to presence of one or more compounds selected from the group comprising ammonium hydroxide, ammonia, nitrogen compounds, basic compounds and alkaline compounds.

In accordance with one of the preferred embodiments of the present invention, the pH varies from about 6 to about 11.

In accordance with one of the preferred embodiments of the present invention, the pH more particularly varies from about 7 to about 11.

In accordance with one of the preferred embodiments of the present invention, the pH even more particularly varies from about 9 to about 11.

In accordance with one of the preferred embodiments of the present invention, the pH referred is of wash water for desalter used in the crude oil processing system.

In another embodiment, the present invention also relates to a method for removing calcium from crude oil or its blends containing calcium naphthenate under basic or alkaline conditions and having a pH varying from about 5 to 11, wherein the additive added to crude oil or its blend or wash water for the desalter is glyoxylic acid.

In accordance with one of the preferred embodiments of the present invention, the basic or alkaline conditions of crude processing system (crude oil or its blends or wash water) are due to presence of one or more compounds selected from the group comprising ammonium hydroxide, ammonia, nitrogen compounds, basic compounds and alkaline compounds.

In accordance with one of the preferred embodiments of the present invention, the pH varies from about 6 to about 11.

In accordance with one of the preferred embodiments of the present invention, the pH more particularly varies from about 7 to about 11.

In accordance with one of the preferred embodiments of the present invention, the pH even more particularly varies from about 9 to about 11.

In accordance with one of the preferred embodiments of the present invention, the pH referred is of wash water for desalter used in the crude oil processing system.

In accordance with one of the preferred embodiments of the present invention, the additive is added in the crude oil phase or wash water for the desalter.

In yet another embodiment, the present invention also relates to use of glyoxylic acid for removal of calcium from crude oil or its blends containing calcium naphthenate under basic or alkaline conditions and having a pH varying from about 5 to 11.

In accordance with one of the preferred embodiments of the present invention, the basic or alkaline conditions of crude processing system (crude oil or its blends or wash water) are due to presence of one or more compounds selected from the group comprising ammonium hydroxide, ammonia, nitrogen compounds, basic compounds and alkaline compounds.

In accordance with one of the preferred embodiments of the present invention, the pH varies from about 6 to about 11.

In accordance with one of the preferred embodiments of the present invention, the pH more particularly varies from about 7 to about 11.

In accordance with one of the preferred embodiments of the present invention, the pH even more particularly varies from about 9 to about 11.

In accordance with one of the preferred embodiments of the present invention, the pH referred is of wash water for desalter used in the crude oil processing system.

In accordance with one of the preferred embodiments of the present invention, the additive is added in the crude oil phase or wash water for the desalter.

In accordance with one of the preferred embodiments of the present invention, the glyoxylic acid is identifiable by cas no. 298-12-4.

In accordance with one of the preferred embodiments of the present invention, the glyoxylic acid is taken in an amount varying from about 1:1 to 1:3 mole ratio of calcium to glyoxylic acid.

In accordance with one of the preferred embodiments of the present invention, the glyoxylic acid is taken in an amount varying from about 1 to about 2000 ppm in the crude oil or its blends or wash water for desalter.

The inventor has found that even small amount of one or more compounds selected from the group comprising ammonium hydroxide, ammonia, nitrogen compounds, basic compounds and alkaline compounds varying up to about 500 ppm in-activates other acids, but, surprisingly and unexpectedly, does not in-activate (deactivate) effects of glyoxylic acid (present additive).

Accordingly, in accordance with one of the more preferred embodiments of the present invention, the present invention is more particularly applicable under following conditions:

a) basic or alkaline conditions of wash water;
b) at pH of wash water, which is preferably 6 or more, more preferably 9 or more;
c) at pH of mixture in desalter, which is 6 or more, preferably between about 6 to about 9;
d) at pH of wash water or desalter system, which may vary from about 6 to about 11 due to basic or alkaline conditions.

It may be noted that basic or alkaline conditions may be achieved by one or more of the compounds selected from a group comprising ammonia, ammonium hydroxide, nitrogen compounds, amine compounds, basic compounds and alkaline compounds.

It may also be noted that treatment of crude oil or wash water for removal of calcium can be carried out by any known method.

In accordance with one of the embodiments of the present invention, the treatment is carried out as described in the following examples a reference to which is drawn herein for the purpose of describing and claiming the method for removal of calcium from the crude oil containing calcium naphthenate under basic or alkaline conditions.

In accordance with one of the embodiments of the present invention, the treatment for the purpose of describing and claiming the method for removal of calcium from the crude oil containing calcium naphthenate is carried out by heating the reacting mixture to about 130° C.

The present invention is now explained with the help of following experimental studies conducted by the inventor, which have been incorporated for explaining its best mode and are not intended to limit its scope.

EXAMPLES OF THE INVENTION

In following experimental studies, each additive—glyoxylic acid (additive of present invention), glycolic acid, malic acid, maleic anhydride, and D-gluconic acid (additives of prior art) was individually charged with calcium napthenate (Ca-naphthenate) solution in toluene into a stainless steel autoclave and reacted at 130° C.

In accordance with one of the embodiments, the solution of Ca-Napthenate was prepared in toluene followed by addition of selected additive and ultra pure water [demineralized (DM) water] without pH adjustment (for present additive, and prior art additives—glycolic acid, malic acid) and with pH adjustment (for present additive, and prior art additives—glycolic acid, malic acid, maleic anhydride, and D-gluconic acid). The individual resulted solutions were heated to 130° C. for 10, 20 and 30 mins followed by cooling to room temperature. The individual resulted reacted solution was poured into a separating funnel and shaken. The two separated layers were formed with top layer being the hydro carbonaceous layer and the bottom layer being the aqueous layer. The top layer was analyzed for Ca content using Inductive Coupled Plasma [ICP], and the dried sample from top layer was also analyzed for its Acid Value.

As per preferred method of experimental studies, about 75 grams of Ca-naphthenate in toluene having an amount of Ca of 2247 ppm in the hydrocarbon layer, and about 75 grams of DM water having amount of selected additive as per Table-I, II, III and IV, wherein amount of selected additive is expressed in its 100% active form were reacted for 10, 20 and 30 mins.

In case of Experiment Nos. 4-8 [Table II], 9-11 [Table III] and 12-14 [Table IV] the pH of solution of additive in DM water was adjusted to pH 9 by using ammonium hydroxide.

The results for experiments without pH adjustment are given Table-I for 10 min treatment, and for experiments after pH adjustment to pH 9 are given in Table-II for 10 min treatment, in Table-III for 20 min treatment, and Table-IV for 30 min treatment.

As efficiency of present additive in removing Ca was more than 99%, further experiments for treatment for 20 and 30 minutes were not performed without pH adjustment.

Experiment Nos. 1, 2, and 3 without pH Adjustment [Table-I]

The pH of water used for extraction after adding selected additive without pH adjustment was found to be as follows:

pH of Glyoxylic Acid was found to be 2.17;

pH of Glycolic Acid was found to be 2.52; and pH of Malic Acid was found to be 2.3.

TABLE I

| Expt. no. | Additive | Wt. of additive (gm) | Acid Value (mgKOH/gm) | Ca in Top layer (ppm) | % Efficiency for removal of Ca |
|---|---|---|---|---|---|
| 1 | Glyoxylic Acid [Present invention] | 0.62 | 213.40 | 9 | 99.6 |
| 2 | Glycolic Acid [prior art] | 0.64 | 165 | 465 | 79.3 |
| 3 | Malic Acid [prior art] | 0.5645 | 174 | 368 | 83.6 |

Experiment Nos. 4, 5, 6, 7 and 8 After 10 Mins Treatment and pH Adjustment to pH 9 [Table-II]

TABLE II

| Expt. no. | Additive | Wt. of additive (gm) | Acid Value (mgKOH/gm) | Ca in Top layer (ppm) | % Efficiency for removal of Ca |
|---|---|---|---|---|---|
| 4 | Glyoxylic Acid [Present invention] | 0.62 | 121.06 | 867 | 61.4 |
| 5 | Glycolic Acid [prior art] | 0.64 | 94.36 | 1481 | 34 |
| 6 | Malic Acid [prior art] | 0.5645 | 101.93 | 1291 | 42.5 |
| 7 | Maleic anhydride [prior art] | 0.413 | 66.8 | 1691 | 24.7 |
| 8 | D-Gluconic acid [prior art] | 1.65 | 111.5 | 1315 | 41.5 |

Experiment Nos. 9, 10 and 11 After 20 Mins Treatment and pH Adjustment to pH 9 [Table-III]

TABLE III

| Expt. no. | Additive | Wt. of additive (gm) | Acid Value (mgKOH/gm) | Ca in Top layer (ppm) | % Efficiency for removal of Ca |
|---|---|---|---|---|---|
| 9 | Glyoxylic Acid [Present invention] | 0.62 | 137.42 | 644 | 71.3 |
| 10 | Glycolic Acid [prior art] | 0.64 | 96.43 | 1467 | 34.7 |
| 11 | Malic Acid [prior art] | 0.5645 | 105.19 | 1261 | 46.86 |

Experiment Nos. 12, 13 and 14 After 30 Mins Treatment and pH Adjustment to pH 9 [Table-IV]

TABLE IV

| Expt. no. | Additive | Wt. of additive (gm) | Acid Value (mgKOH/gm) | Ca in Top layer (ppm) | % Efficiency for removal of Ca |
|---|---|---|---|---|---|
| 12 | Glyoxylic Acid [Present invention] | 0.62 | 151.92 | 562 | 75 |
| 13 | Glycolic Acid [prior art] | 0.64 | 101.34 | 1429 | 36.5 |
| 14 | Malic Acid [prior art] | 0.5645 | 108.76 | 1219 | 45.7 |

From above Tables, it can be observed and concluded that the Ca content in the top layer is, surprisingly and unexpectedly, much lower for the layer obtained after treatment with additive of present invention as compared to the top layers obtained after treatment with prior art additives.

The Acid Value of the dried sample obtained from the top layer after treatment with additive of present invention is higher than that of the dried samples obtained from the top layers after treatment with additives of prior art.

The above experiments confirm that additive of present invention has much better efficiency to remove Ca from crude oil (or its blends) containing Ca-naphthenate not only at low pH of about 2.17 just after treatment of 10 mins., but it also has much better efficiency to remove Ca from crude oil (or its blends) containing Ca-naphthenate even at high pH of about 9 after treatment of about 10, 20 and 30 mins.

Therefore, from above experimental studies, it can be concluded that glyoxylic acid of present invention is better additive than prior art additives, as the calcium removing efficiency of glyoxylic acid, surprisingly and unexpectedly, even at low pH, just after 10 minutes of treatment, is more than 99% as compared to 79.3% and 83.6% for glycolic and malic acid respectively [re Table-I];

even at high pH of about 9 and under alkaline conditions, after 10 minutes of treatment, is more than 60% as compared to 34%, 42.5%, 24.7%, and 41.5% for glycolic acid, malic acid, maleic anhydride, and D-Gluconic acid respectively [re Table-II];

even at high pH of about 9 and under alkaline conditions, after 20 minutes of treatment, is more than 70% as compared to 34.7% and 46.86% for glycolic and malic acid respectively [re Table-III]; and even at high pH of about 9 and under alkaline conditions, after 30 mins of treatment, is about 75% as compared to 36.5% and 45.7% for glycolic and malic acid respectively [re Table-IV].

Experiment Nos. 15, 16 and 17 After 10 Mins Treatment and pH Adjustment to 10.4 [Table-V]

In another set of experiments [Examples 15, 16 and 17—re Table V], 650 ml of crude oil containing calcium Naphthanate (with calcium content of about 400 ppm) was tested after mixing in 73 ml of wash water having 100 ppm of ammonia and pH of 10.4. The ratio of crude oil to water was maintained at about 90 to 10. The mixing was carried out in a high speed blender for 30 seconds. The mixture was then poured into the EDDA tubes (Electro static Desalting Dehydration Apparatus, supplied by Inter AV, USA) to just about 100 ml mark, and a calcium removing agent—glycolic acid and dl malic acid (prior art additives), glyoxylic acid (present invention additive), demulsifier (about 30 ppm) were was added individually in a tube. With every test, a blank test without the calcium removing agent was conducted for comparison purposes. The tubes with respective calcium removing agent were placed in the EDDA heating block at the desired test temperature of 130° C. The tubes were then capped with electrode caps and placed in the heating block for approximately ten minutes. The tubes were shaken for 2 minutes and placed back in the heating block to reheat for ten minutes. The electrode cover was then placed over the tubes and locked into place. The 3000 volts voltage was applied for eight minutes. At the end of eight minutes, the tubes were taken out for measuring the amount of water, which is the percent water drop. The calcium content of the crude phase was measured after 10 minutes using ICP (Inductive coupled plasma) in each tube, and results are given in Table V.

TABLE V

| Expt. no. | Additive | Wt. of additive (gm) | Ca in Top layer (ppm) |
|---|---|---|---|
| 15 | Glyoxylic Acid [Present invention] | 0.115 | 5 |
| 16 | Glycolic Acid [prior art] | 0.119 | 51 |
| 17 | Malic Acid [prior art] | 0.105 | 45 |

The calcium content of the crude phase of the blank run was 274 ppm.

Thus, from Table V, it can be concluded that glyoxylic acid of present invention is far better additive than prior art additives for calcium removing even at high pH of about 10.4 and under alkaline conditions, as can be seen from the calcium content of the top layer, which is surprisingly and unexpectedly, as low as 5 ppm as compared to 51 ppm and 45 ppm for glycolic and malic acid respectively. Therefore, it can also be concluded from Table V that Glyoxylic acid removes calcium from the crude phase at much faster rate and more effectively than prior art additives at high pH and under alkaline conditions.

As performance of present additive for 10 minutes interval was far better/superior than prior art additives, further experiments were not required for higher time intervals, and hence, were not carried out.

In another set of Experiment Nos. 18-20, 21-23 and 24-26, the pH of solution of additive in DM water was adjusted to pH 6 by using ammonium hydroxide, which can also be compared with findings on without pH adjustment.

The results for experiments after pH adjustment to pH 6 are given in Table-VI for 10 min treatment, in Table-VII for 20 min treatment, and Table-VIII for 30 min treatment.

Experiment Nos. 18 to 20 After 10 Mins Treatment and pH Adjustment to pH 6 [Table-VI]

TABLE VI

| Expt. no. | Additive | Wt. of additive (gm) | Acid Value (mgKOH/gm) | Ca in Top layer (ppm) | % Efficiency for removal of Ca |
|---|---|---|---|---|---|
| 18 | Glyoxylic Acid [Present invention] | 0.62 | 137.2 | 720 | 67.9 |
| 19 | Glycolic Acid [prior art] | 0.64 | 96.5 | 1213 | 46 |
| 20 | Malic Acid [prior art] | 0.5645 | 109.0 | 1255 | 44.1 |

Experiment Nos. 21 to 23 After 20 Mins Treatment and pH Adjustment to pH 6 [Table-VII]

TABLE VII

| Expt. no. | Additive | Wt. of additive (gm) | Acid Value (mgKOH/gm) | Ca in Top layer (ppm) | % Efficiency for removal of Ca |
|---|---|---|---|---|---|
| 21 | Glyoxylic Acid [Present invention] | 0.62 | 158.1 | 490 | 78.2 |
| 22 | Glycolic Acid [prior art] | 0.64 | 98.0 | 1202 | 46.5 |
| 23 | Malic Acid [prior art] | 0.5645 | 111.0 | 1205 | 46.4 |

Experiment Nos. 24 to 26 After 30 Mins Treatment and pH Adjustment to pH 6 [Table-VIII]

TABLE VIII

| Expt. no. | Additive | Wt. of additive (gm) | Acid Value (mgKOH/gm) | Ca in Top layer (ppm) | % Efficiency for removal of Ca |
|---|---|---|---|---|---|
| 24 | Glyoxylic Acid [Present invention] | 0.62 | 174 | 427 | 81.0 |
| 25 | Glycolic Acid [prior art] | 0.64 | 105.5 | 1195 | 46.8 |
| 26 | Malic Acid [prior art] | 0.5645 | 113.2 | 1170 | 47.9 |

Therefore, from above experimental studies too, it can be concluded that glyoxylic acid of present invention is far better additive than prior art additives, as the calcium removing efficiency of glyoxylic acid, surprisingly and unexpectedly, even at pH of 6 and under alkaline conditions, after 10 minutes of treatment, is about 67.9% as compared to 46% and 44.1% for glycolic and malic acid respectively [re Table-VI];

even at pH of 6 and under alkaline conditions, after 20 minutes of treatment, is about 78.2% as compared to 46.5% and 46.4% for glycolic and malic acid respectively [re Table-VII]; and even at pH of 6 and under alkaline conditions, after 30 mins of treatment, is about 81% as compared to 46.8% and 47.9% for glycolic and malic acid respectively [re Table-VIII].

Experiment Nos. 27 to 29 After 10 Mins Treatment and pH Adjustment to pH 6 with Crude [Table-IX]

In another set of experiments, crude containing calcium naphthenate dissolved in an equal weight of toluene to have concentration of Ca of about 24 ppm was treated with aqueous solution of additives (1:1) by heating to about 130 degree C. in a Parr autoclave under autogenous pressure for 10 minutes and separated into organic and aqueous layers in a separating funnel. The bottom aqueous layer was analyzed for calcium content by Ion chromatography, and results are given in Table IX.

TABLE IX

| Expt. no. | Additive | Wt. of additive (gm) | Ca in Bottom layer (ppm) | % Efficiency for removal of Ca |
|---|---|---|---|---|
| 27 | Glyoxylic Acid [Present invention] | 0.00665 | 16.05 | 66.9 |
| 28 | Glycolic Acid [prior art] | 0.00684 | 12.4 | 51.6 |
| 29 | Malic Acid [prior art] | 0.00600 | 11.2 | 46.7 |

From Table IX, it can be concluded that glyoxylic acid of present invention is better additive than prior art additives, because its calcium removing efficiency from the crude, surprisingly and unexpectedly, is better than prior art additives. It may be noted that just after 10 minutes of treatment, efficiency of glyoxylic acid to remove calcium is about 66.9% as compared to 51.6% and 46.7% for glycolic and malic acid respectively [re Table-IX].

When the experimental results of Tables I, II, III and IV are compiled in one Table, it can be observed that under basic or alkaline conditions and at high pH of about 9, the efficiency to remove Ca is reduced for all the additives, however, the reduction in efficiency of glyoxylic acid is much lower than prior art additives. Further, with increase in treatment time, the efficiency only of glyoxylic acid increases to about 75% in 30 mins treatment confirming that glyoxylic acid is capable of overcoming above-described problems of the prior art. The mechanism for such surprising and unexpected behavior is not know at present, however, it can be concluded that glyoxylic acid is far better than additives of prior art [Re Table X].

TABLE X

| Experimental Results at pH 9 | | | | |
|---|---|---|---|---|
| | % Efficiency for removal | % Efficiency for removal of Ca after adjusting pH to 9 by ammonium hydroxide | | |
| Additive | of Ca without adjusting pH | After 10 mins | After 20 mins | After 30 mins |
| Glyoxylic Acid [Present invention] | 99.6 | 61.4 | 71.3 | 75 |
| Glycolic Acid [prior art] | 79.3 | 34 | 34.2 | 36.5 |
| Malic Acid [prior art] | 83.6 | 42.5 | 46.86 | 45.7 |

When the experimental results of Tables I, VI, VII and VIII are compiled in one Table, it can be observed that under basic or alkaline conditions and at a low pH of about 6, the efficiency to remove Ca is reduced for all the additives, however, the reduction in efficiency of glyoxylic acid is much lower than prior art additives. Further, with increase in treatment time, the efficiency only of glyoxylic acid increases to about 81% in 30 mins treatment confirming that glyoxylic acid is capable of overcoming above-described problems of the prior art. The mechanism for such surprising and unexpected behavior is not know at present, however, it can be concluded that glyoxylic acid is far better than additives of prior art [Re Table XI].

TABLE XI

| Experimental Results at pH 6 | | | | |
|---|---|---|---|---|
| | % Efficiency for removal | % Efficiency for removal of Ca after adjusting pH to 6 by ammonium hydroxide | | |
| Additive | of Ca without adjusting pH | After 10 mins | After 20 mins | After 30 mins |
| Glyoxylic Acid [Present invention] | 99.6 | 67.9 | 78.2 | 81.0 |
| Glycolic Acid [prior art] | 79.3 | 46 | 46.5 | 46.8 |
| Malic Acid [prior art] | 83.6 | 44.1 | 46.4 | 47.9 |

The above experimental studies clearly indicate that under basic or alkaline conditions, the calcium removal efficiency of glyoxylic acid is far superior than the prior art additives.

Accordingly, it can be concluded that glyoxylic acid is, surprisingly and unexpectedly, useful for removal of calcium from crude oil or its blends containing the calcium naphthernate even in presence of ammonia or other alkaline or basic compounds at a pH varying from about 5 to about 11, preferably from about 6 to 11, more preferably from about 7 to 11, even more preferably from about 9 to 11 with ease and economically, and therefore, the present invention provides a solution to long awaited industrial problems in processing mixture of crude oils or its blends containing calcium naphthenate under alkaline or basic conditions.

It may be noted that term "about" appearing before value or range of value is not intended to broaden scope of corresponding value or range of value, but is intended to include, within scope of present invention, the permissible level of experimental error in the field of the invention.

It may be noted that present invention has been described with the help of foregoing experiments which have been performed on the laboratory scale. It is obvious to persons skilled in the art to modify present invention to apply it to industrial scale without deviating from its scope, and such application of present invention is included in its scope.

The invention claimed is:

1. A method for removing calcium from crude oil or its blends containing calcium naphthenate, and having no sulfur or having less than 0.2% by wt. sulfur contents of the crude oil or its blend, and comprising adding to the crude oil or its blends or wash water for desalter an additive consisting of glyoxylic acid; and wherein the crude oil or its blends or the wash water for the desalter have:

i) a pH varying from 5 to 11; and ii) one or more basic or alkaline compounds.

2. The method as claimed in claim 1, wherein the pH varies from 7 to 11.

3. The method as claimed in claim 1, wherein the pH varies from 9 to 11.

4. The method as claimed in claim 1, wherein the glyoxylic acid is identifiable by cas no. 298-12-4.

5. The method as claimed in claim 1, wherein the glyoxylic acid is taken in an amount varying from 1:1 to 1:3 mole ratio of calcium to glyoxylic acid.

6. The method as claimed in claim 1, wherein the glyoxylic acid is taken in an amount varying from 1 to 2000 ppm in the crude oil or wash water for desalter.

7. The method as claimed in claim 1, wherein said pH varies from 6 to 11.

8. The method as claimed in claim 1, wherein said basic or alkaline compound in the crude oil or its blends or the wash water comprise ammonium hydroxide, ammonia, or nitrogen compounds.

* * * * *